US005873151A

United States Patent [19]

Sood

[11] Patent Number: 5,873,151

[45] Date of Patent: Feb. 23, 1999

[54] DECORATIVE BELT LOOP PIN

[76] Inventor: Kathryn C. Sood, 79 Middleton Rd., Boxford, Mass. 01929

[21] Appl. No.: 866,946

[22] Filed: May 31, 1997

[51] Int. Cl.[6] ..... A44B 1/04

[52] U.S. Cl. ..... 24/182; 24/163 K

[58] Field of Search ..... 24/163 K, 182, 24/183

[56] References Cited

U.S. PATENT DOCUMENTS

| | | | |
|---|---|---|---|
| 1,436,277 | 11/1922 | Manning et al. | 24/183 |
| 2,762,146 | 9/1956 | Milazzo | 24/103 |
| 4,377,939 | 3/1983 | Reinsdorf | 63/2 |

*Primary Examiner*—José G. Dees
*Assistant Examiner*—Alton Pryor
*Attorney, Agent, or Firm*—Don Halgren

[57] ABSTRACT

The present invention relates to a decorative belt loop pin for the decorating of an article of clothing and for the securement of a belt to an article of clothing. The belt loop pin comprises a rectangularly shaped frame having a central internal opening of rectangular shape. A front member is arranged to receive a decorative panel thereon. A rear member has an upper end and a lower end, the upper end having an upper standoff thereon, the lower end having a lower standoff thereon. The upper standoff has an elongated securement pin hingedly attached thereto. The lower standoff has a securement grasping member thereon. The internal opening of the rectangular frame crtically has a minimum length of about one inch, and a minimum width of about at least three-eighths of an inch, to permit a belt to be readily passed therethrough.

9 Claims, 1 Drawing Sheet

DECORATIVE BELT LOOP PIN

BACKGROUND OF THE INVENTION

1. Field of the Invention

This invention relates to functional jewelry and more particularly to a decorative pin which functions as a belt loop.

2. Prior Art

Current customs of dress and clothing often omit belt loops on slacks, pants, and skirts or dresses. It may be desirable to add a number of belt loops on any of those articles of clothing, or to be able to adjust them as necessary. Those articles of clothing which do have belt loops, may have their belt loops which are too loose, or they may break.

It is an object of the present invention however, to provide a decorative belt loop pin, which may be utilized on an article of clothing at the discretion of the wearer.

It is an object of the present invention, to provide a decorative belt loop pin, which will readily accommodate most typical belts without jamming or breaking.

It is yet a further object of the present invention, in one embodiment thereof, to provide a belt loop pin which is flexible so as to flex or yield with the width of the belt, when the wearer is bending or moving.

It is still yet a further object of the present invention, to provide a belt loop pin which will not dig into the sides of the wearer or make the wearer uncomfortable.

BRIEF SUMMARY OF THE INVENTION

The present invention comprises a belt loop pin, having portions made from a rigid metallic or plastic material, and which belt loop pin is of rectilinear configuration. The belt loop pin of the present invention thereby acting as a functional item of jewelry to be worn as securing clothing to the wearer, and to decorate that clothing as well.

The rectilinear configuration of the present belt loop pin is critical, so as to permit a belt of the required size to fit readily therethrough. The belt loop pin comprises a rectangular frame having a central passageway therethrough. The central passageway has a length of a minimum of about one inch and a width of at least about three eighths of one inch. These minimum dimensions are critical, so as to permit a typical belt, often with multiple layers of material, to pass therethrough. The width dimensions will also permit the typical multiple stitched-together leather or the like to pass readily therewithin.

The rectangular frame of the belt loop pin has a rear side. The rear side of the frame of the belt loop pin has a first or upper standoff at an upper end thereof. The standoff at the upper end includes an elongated hingedly mounted pin attached to the standoff. The lower end of the rear side of the rectangular frame member of the belt loop pin has a second or lower standoff extending thereon. The lower standoff includes a grasping member which captures the distal tip of the elongated pin. The grasping member includes a slot with a finger moveable therearound, so as to secure the distal end of the elongated pin therein, in a known manner.

The rectangular shape of the belt loop pin has a front face plate thereon. A decorative panel may be attached to the face plate on the front of the belt loop pin. The decorative face plate may be attached via an adhesive, a screw means, or the decorative face plate may have longitudinal edges which extend around the side portions of the front face plate, so as to securely hold the decorative panel thereto.

In a further embodiment of the present invention, the rear panel of the rectangularly shaped belt loop pin, has a gap extending thereacross. This gap provides an open space in the rear panel between the upper standoff and the lower standoff. This gap permits a belt or article of clothing to be slipped through the gap in the rear panel of the pin, and not necessarily fed through the side openings on the belt loop pin itself. This feature may make it easier to add or remove the pin from the belt.

In yet a further embodiment of the present invention, the belt loop pin is comprised of a pair of opposed U-shaped channel members, spaced apart the minimum distance, each channel member having a front lip thereon. The front lip of each channel member faces its opposed member, and has a flexible fabric attached to each respective lip and bridging the two lips. The two channels thus comprising an upper member and a lower member attached by a flexible web of material permitting a certain degree of bending and flexibility to the pin when it is worn as a belt loop attached to an article of clothing. The elongated pin and the grasping element on the rear upper and lower lips of the belt loop pin respectively, of this embodiment, are engagable as was described hereinabove.

A further critical feature of the present invention, is that the standoffs which secure the elongated articulable pin and the standoff for the grasping component be no further than three-eighths of an inch from the end of each respective portion of the pin. That is, the upper and lower edges of each standoff must be no closer than three-eighths away from the upper and lowermost ends of the belt loop pin. This minimizes the likelihood of piercing or pinching the body or side of a wearer of this belt loop pin, when a wearer bends or twists wearing these belt loops.

The invention thus comprises a decorative belt loop pin for the decorating of an article of clothing and for the securement of a belt to an article of clothing, comprising a rectangularly shaped frame having a central internal opening therethrough of rectangular shape, a front member arranged to receive a decorative panel thereon, a rear member having an upper end and a lower end, the upper having an upper standoff thereon, the lower end having a lower standoff thereon, the upper standoff having an elongated securement pin hingedly attached thereto, the lower standoff having a securement grasping member thereon; and the internal opening of the rectangular frame having a minimum length of about one inch, and a minimum width of about at least three-eighths of an inch, to permit a belt to be readily passed therethrough. The decorative panel for the front member has flanged edges so as to snap onto the front member in a changable and readily decorable manner. The rear member has a gap thereacross, between the standoffs to permit a belt or article of clothing to be inserted into the central internal opening. The front member has a gap thereacross, the frame member thus comprising an upper "U" shaped channel member and a lower "U" shaped channel member, the upper and the lower channel members each having a front lip, the front lips having a flexible fabric extending therebetween, to provide flexibility and twistability to the decorative belt loop pin. The upper standoff has an uppermost edge and the lower standoff has a lowermost edge, the uppermost edge and the lowermost edge of the respective standoffs being no closer than three-eigthts of an inch to the uppermost and lowermost ends of the decorative pin, to minimize the liklihood of pinching of a wearer of the decorative pin.

The invention also includes a method of decorating an article clothing and securing a belt to that article of clothing, comprising the steps of: providing a rectangularly shaped frame having a central internal opening therethrough of rectangular shape, the frame having a front member arranged to receive a decorative panel thereon, the frame having a rear member with an upper end and a lower end, the upper end having an upper standoff thereon, the lower end having a lower standoff thereon, the upper standoff having an elongated securement pin hingedly attached thereto, the lower standoff having a securement grasping member thereon, and the internal opening of the rectangular frame having a minimum length of about one inch, and a minimum width of about at least three-eighths of an inch, to permit a belt to be readily passed therethrough; attaching the rectangularly shaped frame to an article of clothing; and placing a belt through the rectangular shaped central opening in the frame member. The method includes the step of: attaching a decorative panel to the front member by engagement of a pair of flanged edges around the sides of the panel, so as to snap onto the front member in a changable and readily decorable manner. The method includes the step of: placing a gap in the rear panel member so as to permit a belt or article of clothing to be placed therethrough more easily than through openings in the sides of the decorative pin, and placing a gap across the front member, the frame member thus comprising an upper "U" shaped channel member and a lower "U" shaped channel member, the upper and the lower channel members each having a front lip, and attaching a flexible fabric across the gap between the front lips of the upper and lower channel shaped members, to provide flexibility and twistability to the decorative belt loop pin.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1:
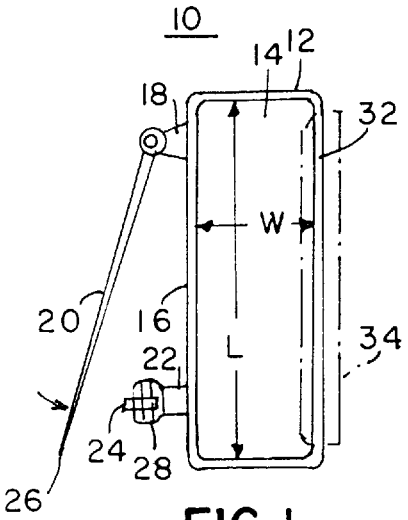
FIG. 1 is a side elevational view of a rectilinear belt loop pin constructed according to the principles of the present invention.

Referring to the drawings in detail, and particularly to FIG. 1, there is shown a decorative belt loop pin 10, having portions made from a rigid metallic or plastic material, and which belt loop pin 10 is of rectilinear configuration, in a side view, as shown. The decorative belt loop pin 10 of the present invention thereby acts as a functional item of jewelry to be worn as securing clothing to the wearer, and to decorate that clothing as well.

Figure 2:
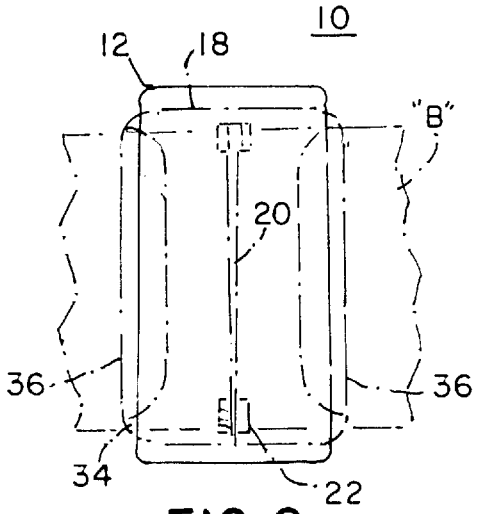
FIG. 2 is a elevational view of the front of a belt loop pin constructed according to the principles of the present invention, with a belt and a decorative attachable panel thereon shown in phantom.

The rectilinear configuration of the present decorative belt loop pin 10 is critical to the invention, so as to permit a belt "B", of the required size to fit readily therethrough, the belt "B" being shown in phantom in FIG. 2. The belt loop pin 10 comprises a rectangular frame 12 having a rectangular central passageway 14 therethrough. The central passageway 14 has a minimum length "L" of about one inch and a width "W" of at least about three-eighths of one inch. These minimum dimensions are critical, so as to permit a typical belt, often with multiple layers of material, to easily pass therethrough. The width dimensions will also permit the typical multiple stitched-together leather or the like to pass readily therewithin.

The rectangular frame 12 of the decorative belt loop pin 10 has a rear side member 16. The rear side member 16 of the frame 12 of the decorative belt loop pin 10 has a first or upper standoff 18 at an upper end thereof. The upper standoff 18 at the upper end includes an elongated securement pin 20 hingedly attached to the upper standoff 18. The lower end of the rear side member 16 of the rectangular frame member 12 of the decorative belt loop pin 10 has a second or lower standoff 22 extending therefrom. The lower standoff 22 includes a grasping member 24 which captures the distal tip 26 of the elongated securement pin 20. The grasping member 24 includes a slot 28 with a finger 30 moveable therearound, so as to secure the distal end tip 26 of the elongated securement pin 20 therein, in a known manner.

The rectangular shape of the decorative belt loop pin 10 has a front face member 32 thereon. A decorative panel 34 may be attached to the face member 32 on the front of the belt loop pin 10. The decorative face member 32 may be attached via an adhesive, a screw means, or the decorative face plate may have longitudinal edges 36 which extend around the side portions of the front face plate, so as to securely hold the decorative panel thereto, as shown in phantom, in FIG. 2.

Figure 3:
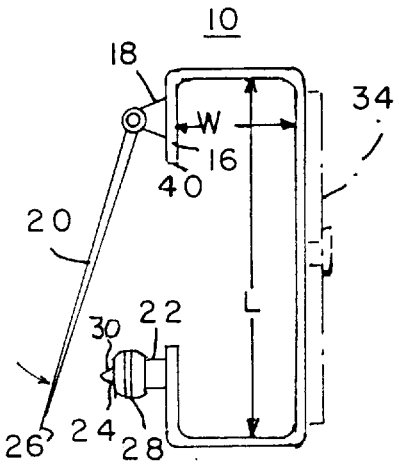
FIG. 3 is a side elevational view of a further embodiment of the present invention.

In a further embodiment of the present invention, as shown in FIG. 3, the rear side member 16 of the rectangularly shaped decorative belt loop pin 10, has a gap 40 extending thereacross. This gap 40 provides an open space in the rear member 16 between the upper standoff 18 and the lower standoff 22. This gap 40 permits a belt "B" or article of clothing to be slipped through the gap 40 in the rear member 16 or side of the decorative belt loop pin 10, and not necessarily fed through the side openings on the decorative belt loop pin 10 itself. This feature may make it easier to add or remove the decorative belt loop pin 10 from a belt, or vice versa.

Figure 4:
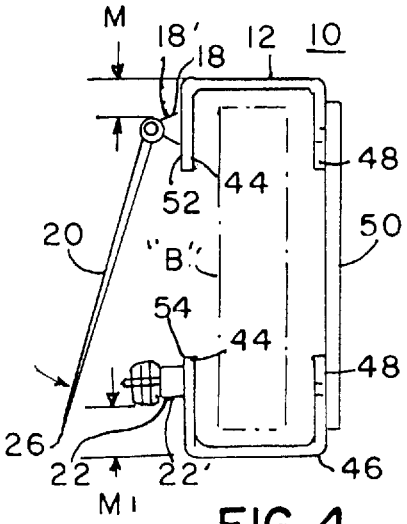
FIG. 4 is a side elevational view of a belt loop pin in yet still a further embodiment.
Figure 5:
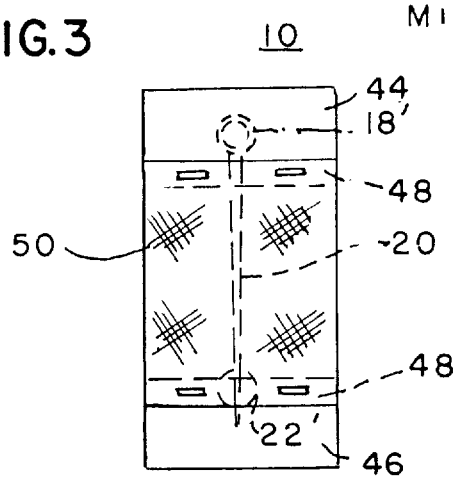
FIG. 5 is a view taken along the lines 5—5 of FIG. 4.

In yet a further embodiment of the present invention, as shown in FIGS. 4 and 5, the decorative belt loop pin 10 is comprised of an upper and a lower U-shaped channel member 44 and 46, spaced apart the minimum distance "L", each channel member 44 and 46 having its minimum internal width "W" of three-eighths of an inch, and having a front lip 48 thereon. The front lip 48 of each channel member 44 and 46 faces its opposed member, and has a flexible fabric 50 attached to and bridging the two respective lips 48. The two channel members 44 and 46 thus comprise an upper member and a lower member attached by a flexible web of material to permit a certain degree of bending and flexibility to the decorative pin assembly when it is worn as a belt loop attached to an article of clothing. The elongated securement pin 20 and the grasping element 24 on the rear upper and lower lips 52 and 54 of the decorative belt loop pin 10 respectively, in this embodiment, are engagable as was described hereinabove.

A further critical feature of the present invention, is that the standoff 18 which secures the elongated articulable securement pin 20 and the standoff 22 for the grasping member 24 be no closer than three-eighths of an inch from the end of each respective portion of the decorative pin 10, as shown in representative manner in FIG. 4. That is, the upper and lower edges 18' and 22' of each standoff respectively, must be no nearer than three-eighths of an inch away from the uppermost and lowermost ends of the decorative belt loop pin 10, those dimensions represented as M and $M_1$. This distance condition minimizes the likelihood of piercing or pinching the body or side of a wearer of this belt loop pin, when a wearer bends or twists wearing these belt loops.

I claim:

1. A decorative belt loop pin for the decorating of an article of clothing and for the securement of a belt to an article of clothing, comprising:

a rectangularly shaped frame having a central internal opening therethrough of rectangular shape;

a front member having a decorative panel thereon;

a rear member having an upper end and a lower end, said upper end having an upper standoff thereon, said lower end having a lower standoff thereon;

said upper standoff having an elongated securement pin hingedly attached thereto, said lower standoff having a securement grasping member thereon; and said internal opening of said rectangular frame having a minimum length of about one inch, and a minimum width of about at least three-eighths of an inch, to permit a belt to be readily passed therethrough.

2. The decorative belt loop pin as recited in claim 1, wherein said decorative panel for said front member has flanged edges so as to snap onto said front member in a changable and readily decorable manner.

3. The decorative belt loop pin as recited in claim 1, wherein said rear member has a gap thereacross, between said standoffs to permit a belt or article of clothing to be inserted into said central internal opening.

4. The decorative belt loop pin as recited in claim 3, wherein said front member has a gap thereacross, said frame member thus comprising an upper U shaped channel member and a lower U shaped channel member, said upper and said lower channel members each having a front lip, said front lips having a flexible fabric extending therebetween, to provide flexibility and twistability to said decorative belt loop pin.

5. The decorative belt loop pin as recited in claim 1, wherein said upper standoff has an uppermost edge and said lower standoff has a lowermost edge, said uppermost edge and said lowermost edge of said respective standoffs being no closer than three-eigthts of an inch to the uppermost and lowermost ends of said decorative pin, to minimize the liklihood of pinching of a wearer of said decorative pin.

6. A method of decorating an article of clothing and securing a belt to said article of clothing, comprising the steps of:

providing a rectangularly shaped frame having a central internal opening therethrough of rectangular shape, said frame having a front member having a decorative panel arranged thereon; said frame having a rear member with an upper end and a lower end, said upper end having an upper standoff thereon, said lower end having a lower standoff thereon, said upper standoff having an elongated securement pin hingedly attached thereto, said lower standoff having a securement grasping member thereon, and said internal opening of said rectangular frame having a minimum length of about one inch, and a minimum width of about at least three-eighths of an inch, to permit a belt to be readily passed therethrough;

attaching said rectangularly shaped frame to an article of clothing; and placing a belt through said rectangular shaped central opening in said frame member.

7. The method of decorating an article clothing as recited in claim 6, comprising the step of:

attaching said decorative panel to said front member by engagement of a pair of flanged edges therearound of said panel, so as to snap onto said front member in a changable and readily decorable manner.

8. The method of decorating an article clothing as recited in claim 7, comprising the step of:

placing a gap in said rear panel member so as to permit a belt or article of clothing to be placed therethrough more easily than through openings in the sides of said decorative pin.

9. The method of decorating an article clothing as recited in claim 8, comprising the step of:

placing a gap across said front member, said frame member thus comprising an upper "U" shaped channel member and a lower "U" shaped channel member, said upper and said lower channel members each having a front lip;

attaching a flexible fabric across said gap between said front lips of said upper and lower channel shaped members, to provide flexibility and twistability to said decorative belt loop pin.

* * * * *